US006868680B2

(12) United States Patent
Sakuma et al.

(10) Patent No.: US 6,868,680 B2
(45) Date of Patent: Mar. 22, 2005

(54) AIR-CONDITIONING CONTROL APPARATUS USING HEATER

(75) Inventors: Masayoshi Sakuma, Chiyoda-ku (JP); Ryuusuke Gotouda, Chiyoda-ku (JP); Kouji Watanabe, Chiyoda-ku (JP); Minoru Takahashi, Chiyoda-ku (JP); Hidenao Kawai, Chiyoda-ku (JP); Toshio Onodera, Chiyoda-ku (JP); Katsuhiro Joukou, Chiyoda-ku (JP); Yoshihiro Kimoto, Chiyoda-ku (JP); Yutaka Shimokawa, Chiyoda-ku (JP); Makoto Tanaka, Chiyoda-ku (JP)

(73) Assignee: Hitachi Plant Engineering & Construction Co., Ltd., Tokyo (JP)

( * ) Notice: Subject to any disclaimer, the term of this patent is extended or adjusted under 35 U.S.C. 154(b) by 0 days.

(21) Appl. No.: 10/656,175

(22) Filed: Sep. 8, 2003

(65) Prior Publication Data

US 2004/0065096 A1 Apr. 8, 2004

(30) Foreign Application Priority Data

Oct. 7, 2002 (JP) ..... 2002-293556

(51) Int. Cl.[7] ..... F25B 13/00
(52) U.S. Cl. ..... 62/160; 62/324.1
(58) Field of Search ..... 62/160

(56) References Cited

U.S. PATENT DOCUMENTS 4,309,594 A * 1/1982 Jones ..... 392/356
4,680,448 A 7/1987 Fester
5,037,342 A * 8/1991 Barthelmes et al. ..... 445/22
5,947,592 A * 9/1999 Barlow ..... 362/345

FOREIGN PATENT DOCUMENTS

| | | |
|---|---|---|
| DE | 24 46 166 | 4/1976 |
| DE | 198 31 417 A1 | 1/2000 |
| FR | 2 308 875 | 11/1976 |
| JP | A 6-272963 | 9/1994 |

* cited by examiner

*Primary Examiner*—Melvin Jones
(74) *Attorney, Agent, or Firm*—Oliff & Berridge, PLC

(57) ABSTRACT

The heater has increased quick responsiveness to temperature control of air, and the air conditioner can realize highly accurate temperature control using the heater. A duct unit having heat sources comprising electric lamps in the inside thereof is attached to an air duct. Air coming into contact with glass bulbs of the electric lamps is heated by radiant heat and transferred heat generated by lighting the electric lamps, whereby the heater with increased quick responsiveness to temperature control is obtained. A first heater and a second heater are provided in the air duct, respectively, and temperature sensors for controlling these heaters are attached to the air duct and a precision environment chamber, respectively, whereby temperature control in two stages with different temperature resolutions is made possible, and an air conditioner with high accuracy excellent in controllability can be provided.

4 Claims, 5 Drawing Sheets

AIR-CONDITIONING CONTROL APPARATUS USING HEATER

BACKGROUND OF THE INVENTION

1. Field of the Invention

The present invention relates to an air conditioner using a heater, and in particular to an air conditioner which uses a heater provided with heat sources in the inside thereof for heating air to be supplied, and controls air-conditioning so as to keep a room temperature of an air-conditioned room constant.

2. Description of the Related Art

In a clean room (air-conditioned room) used in a semiconductor manufacturing factory or the like, conditions required for working environment tend to be strict. For example, in a precision environment chamber or the like, temperature control in the chamber is required strictly. In particular, in a space where inspection work or the like is actually carried out in the room, highly accurate temperature control is required for an air conditioner, for example, fluctuation of temperature in the space is required to be controlled to ±1/1000° C. or less.

Japanese Patent Application Publication No. 6-272963 discloses an air conditioner provided with a heater and a cooler for maintaining temperature in a room at a desired temperature in order to meet the requirements. The heater and the cooler are feedback controlled while monitoring a room temperature with a temperature sensor or the like to keep the room temperature constant.

As the heater, a heat transfer wire is used, which has a high electric resistance wound around in a coil shape (or plate shape) as a heat source in an air duct (supply path) of the air conditioner. Heat is generated in the heat transfer wire by energizing the heat transfer wire, and air sent by a blower is brought into contact with the heat transfer wire, whereby heated air of a desired temperature is obtained. As the cooler, a cooling coil is provided, in which chilled fluid such as cooling water or fluorocarbon fluid flows, and air is brought into contact with the cooling coil, whereby cooling air of a desired temperature is obtained. That is, a flow rate of chilled fluid cooled to a predetermined temperature is controlled by a pump and supplied to the cooling coil, and air is brought into contact with the cooling coil to keep the air at a desired temperature.

However, the conventional heater has a disadvantage in that it is poor in quick responsiveness to temperature control because it uses the heat transfer wire and is not suitable for an environment in which highly accurate temperature control is desired. Moreover, since the conventional cooler controls temperature of air by controlling a flow rate of supply of chilled fluid to be supplied to the cooling coil, it is difficult to control a flow rate of chilled fluid with respect to controlled temperature of the air. For example, the cooler is poor in quick responsiveness to a change in temperature due to external factors such as an outflow of air caused by opening and closing of a door of a precision environment chamber and is further unsuitable for controlling temperature with high accuracy.

Further, there is a disadvantage in that quick responsiveness cannot be expected with respect to a change in temperature due to external factors as described above simply by providing a heater or a cooler having a single temperature resolution. Furthermore, there is a disadvantage in that, if a plurality of heaters and coolers are provided excessively, control becomes complicated and costs of equipment increase.

SUMMARY OF THE INVENTION

The present invention has been devised in view of such circumstances, and it is an object of the present invention to provide a heater with increased quick responsiveness to temperature control of air, and to provide an air conditioner which can realize highly accurate temperature control using this heater.

In order to attain the above-described object, the present invention is directed to an air-conditioning control apparatus, comprising: a heater which includes a heat source inside thereof and heats supplied air, wherein an electric lamp provided with a filament is used as the heat source, the filament is energized to light the electric lamp, heat generated by lighting the electric lamp is used as the heat source, and at least one said heater is arranged in a supply path for supplying air-conditioning air to an air-conditioned room.

According to the present invention, since heat generated by lighting the electric lamp is used as the heat source for the heater, quick responsiveness to temperature control is improved.

Preferably, the air-conditioning control apparatus further comprises an additional heater arranged in the supply path of air-conditioning air, wherein: the heater with the electric lamp is arranged in the supply path on a downstream side than the additional heater; the additional heater arranged in the supply path on an upstream side is controlled by a first control device with a predetermined resolution according to temperature information from a first temperature sensor arranged on the supply path; the heater with the electric lamp arranged in the supply path on the downstream side is controlled by a second control device with a resolution higher than the first control device according to temperature information from a second temperature sensor arranged at a predetermined position in the air-conditioned room; and air-conditioning air subjected to temperature control with the higher resolution is supplied to the predetermined position.

According to the present invention, at least two heaters, that is, the additional heater (first heater) and the heater with the electric lamp (second heater) are provided in the supply path and the temperature sensors for controlling the first and second heaters are attached to the predetermined positions of the supply path and the air-conditioned room, respectively, whereby temperature control in two stages with different temperature resolutions is realized. Thus, an air conditioner which can control temperature of the air-conditioned room with high accuracy can be provided. That is, air taken into the supply path is first heated to a temperature close to a temperature required for the air-conditioned room by the first heater and, then, temperature of the air is controlled, for example, by a unit in the order of 1/1000° C. by the second heater with the higher resolution to supply this air to a predetermined position of the air-conditioned room. Consequently, air-conditioning air, which is subjected to highly accurate temperature control to have fluctuation of temperature eliminated, can be supplied to the air-conditioned room.

Preferably, the heater with the electric lamp is arranged in a duct unit detachably attached to the supply path; and an opening for removing the heater with the electric lamp from the duct unit is formed in the duct unit, and a cover for opening and closing the opening is attached to the opening.

According to the present invention, since the heater is provided in the duct unit, the duct unit only has to be removed from the supply path when the entire heater is repaired or replaced. Thus, replacement work is facilitated.

If the cover is opened to remove the heater from the duct unit, maintenance of each member of the heater can be performed.

Preferably, the air-conditioning control apparatus further comprises: a cooler which cools air taken into the supply path to a predetermined temperature and is arranged in the supply path on an upstream side than the heater, the cooler comprising: a pump which continuously supplies chilled fluid stored in a chilled fluid producing apparatus to the cooler via a fluid path; a temperature sensor which measures temperature of the chilled fluid continuously supplied by the pump and is arranged on the fluid path; and a chilled fluid temperature control device which feedback controls temperature of the chilled fluid according to information from the temperature sensor and is arranged on the fluid path.

According to the present invention, since a fixed amount of chilled fluid, which is subjected to temperature control by the heater, is continuously supplied to control temperature of the air rather than controlling a flow rate of the chilled fluid, highly accurate temperature control becomes possible. Since load of temperature control on the first heater is reduced by providing such a cooler on the upstream side of the first heater, highly accurate temperature control can also be realized in the first heater and temperature control by the second heater is improved accordingly. Thus, for example, air of a fixed temperature subjected to temperature control in the order of 1/1000° C. can be supplied to the air-conditioned room.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

A preferred embodiment of a heater in accordance with the present invention and an air conditioner using this heater will be hereinafter described with reference to the accompanying drawings.

Figure 1:
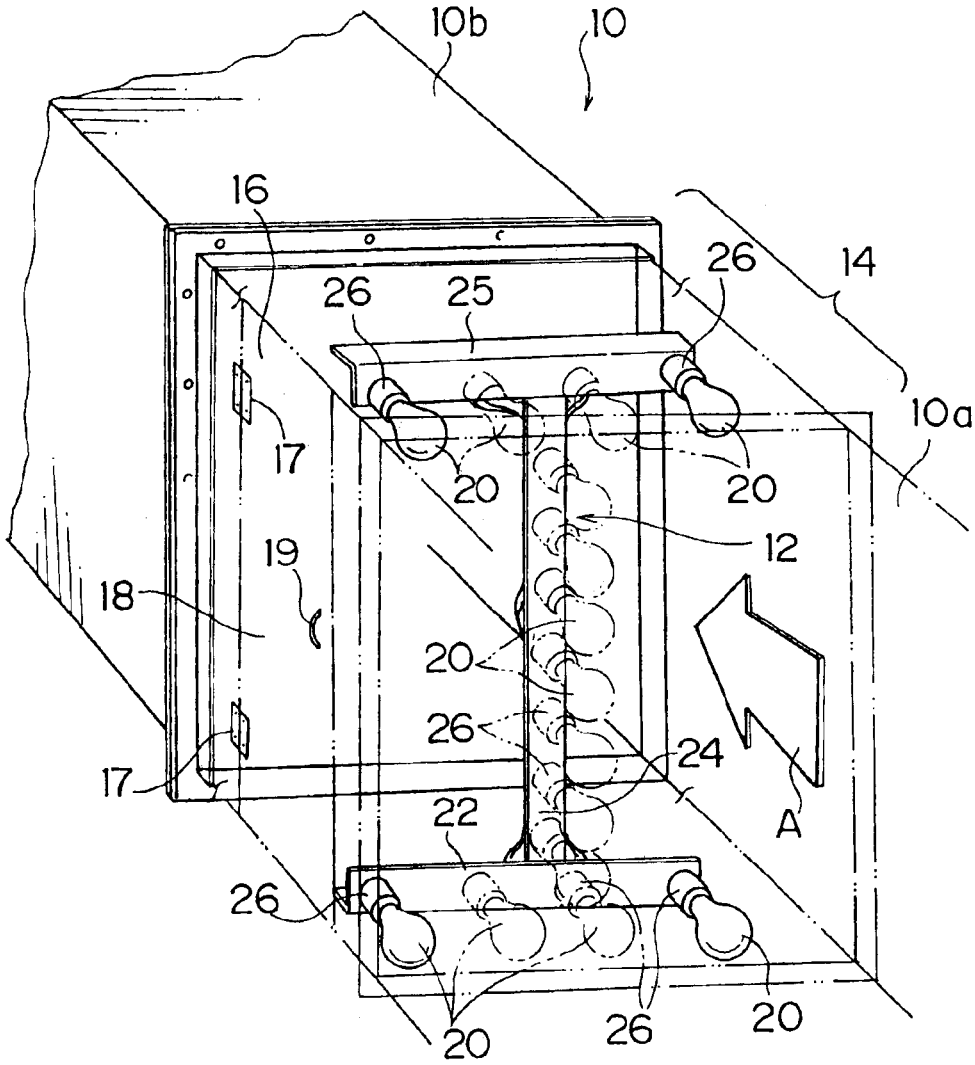
FIG. 1 is a perspective view showing a heater in accordance with an embodiment of the present invention.

FIG. 1 is a perspective view showing an example in which a heater according to an embodiment of the present invention is provided in an air duct 10 (supply path). As shown in FIG. 1, the air duct 10 includes a duct unit 14 provided with a heater 12, and an upstream side air duct 10*a* and a downstream side air duct 10*b* detachably coupled to the duct unit 14. Air supplied from the upstream side air duct 10*a* is heated by the heater 12 and then flows to the downstream side air duct 10*b*.

A rectangular opening 16 for removing the heater 12 is formed on a side of the duct unit 14, and a cover 18 for opening and closing the opening 16 is attached to the side of the duct unit 14 via hinges 17. A handle 19 is attached to the cover 18, and the cover 18 can be locked and unlocked by a lock mechanism (not shown).

The heater 12 includes fifteen electric lamps 20. These electric lamps 20 are attached to predetermined positions of a frame structure which is formed in an H shape by combining a lower frame 22, a vertical frame 24, and an upper frame 25.

Figure 2:
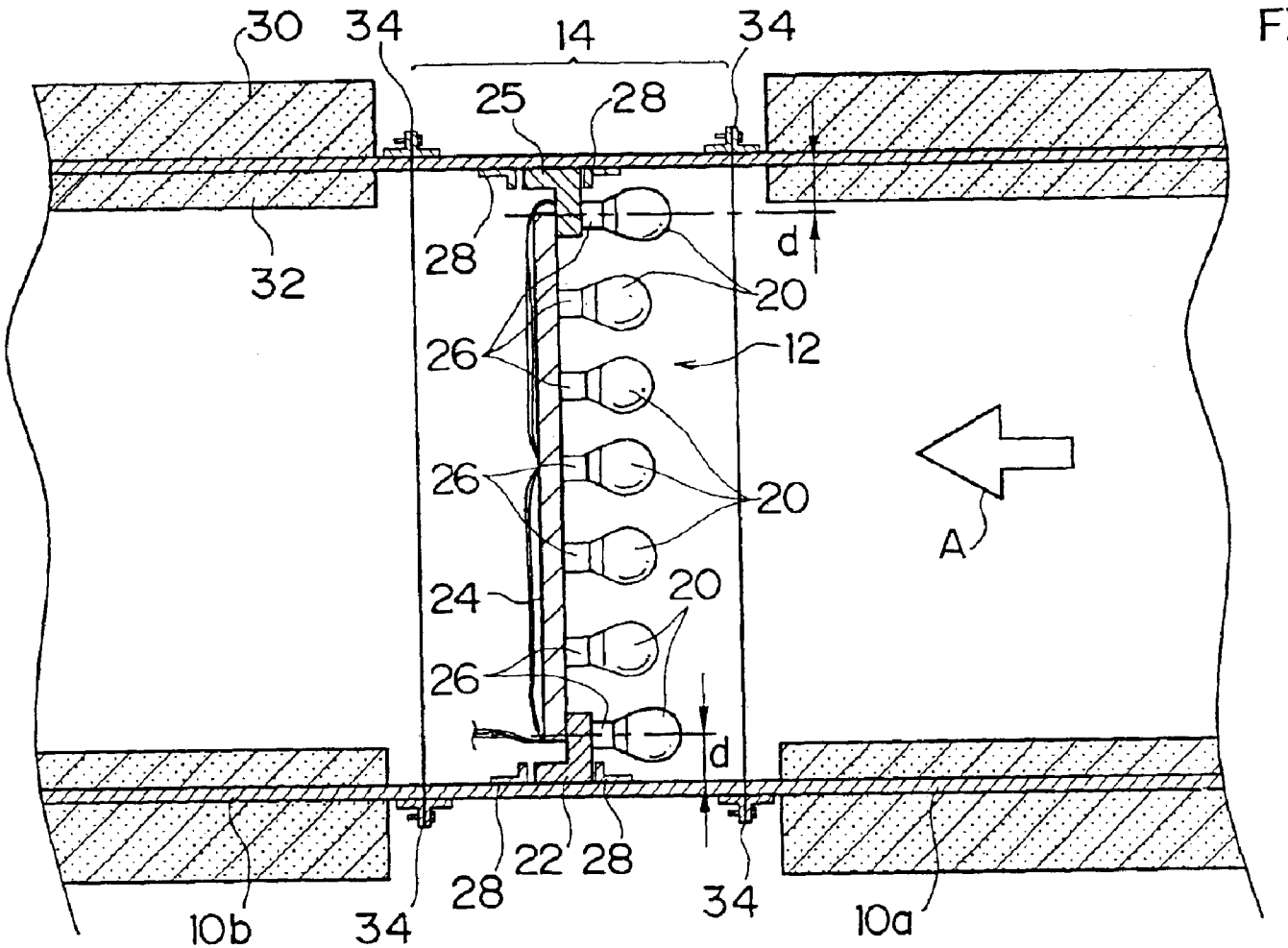
FIG. 2 is a side view showing the heater.

As shown in FIG. 2, the lower frame 22 and the upper frame 25 of the frame structure are nipped and slidably supported by rails 28 provided on a ceiling surface and a floor surface on the inner side of the duct unit 14. The rails 28 are disposed in a direction perpendicular to an axial direction of the duct unit 14, whereby it is possible to remove the frame structure from the duct unit 14 or arrange it therein through the opening 16.

Electric lamp sockets 26 are provided at both ends of the lower frame 22 and the upper frame 25, and electric lamp sockets 26 are provided at a central position of the vertical frame 24 as well. When the electric lamps 20 are attached to these electric lamp sockets 26, bulbs of the electric lamps 20 are opposed to a sending direction of air (arrow A in FIGS. 1 and 2), and the bulbs of the electric lamps 20 face the right-hand side in FIG. 2. Wiring (not shown) connects the electric lamp sockets 26 and a power supply section (not shown), and a voltage of the power supply section is controlled by a thyristor 70 or 76 described later (see FIG. 3). Here, the electric lamp sockets 26 may be connected in series or may be connected in parallel with each other. Attachment positions of the electric lamp sockets 26 provided in the lower frame 22 and the upper frame 25, respectively, are set to positions apart from the ceiling surface or the floor surface by d in FIG. 2, which is approximately 1/10 to 2/10 of a height of the duct unit 14. Consequently, temperature distribution of air becomes uniform on a vertical section of the duct unit 14.

As the electric lamp 20, a halogen electric lamp, in which a metal (e.g., tungsten, etc.) filament is enclosed, is used such that the metal filament can be energized. Flanges 34 are provided outside the duct unit 14 as shown in FIG. 2, and the duct unit 14 is attached to the air ducts 10*a* and 10*b* through the flanges 34. Since the duct unit 14 is thus detachably attached to the air duct 10, replacement work of the entire heater 12 is facilitated, for example, in the case of failure thereof. A degree of freedom of design with respect to the air duct 10 is increased by the duct unit 14 constituted as a unit, and the number of duct units 14 to be set and a place of arrangement thereof can be changed easily. For example, in the case where a duct unit 14 is added later, it is sufficient to remove the air duct 10 in a position where the duct unit 14 is set and to set the duct unit 14 in the position.

Insulating materials 30 and 32 used for blocking of heat and heat retention are provided in the air ducts 10*a* and 10*b*. The insulating materials 30 and 32 are attached so as to cover the entire wall surfaces of the air duct 10, whereby heat diffusion and heat absorption are prevented between the inside and the outside of the air duct 10, and influence of heat due to disturbance is prevented to the full. Fiberglass, polystyrene foam, cork, or the like is used as the insulating materials 30 and 32. A wire mesh (not shown) may be provided on the air duct 10*a* side (i.e., upstream side) in the duct unit 14 to prevent foreign bodies from entering.

In a general electric lamp, the surface of the glass bulb is heated with radiant heat by lighting the electric lamp. It is a characteristic of the present invention to heat air coming into contact with the glass bulb by heat transfer utilizing this radiant heat. Compared with a conventional device using a heat transfer coil, satisfactory quick responsiveness can be realized by a thin glass bulb.

Figure 4:
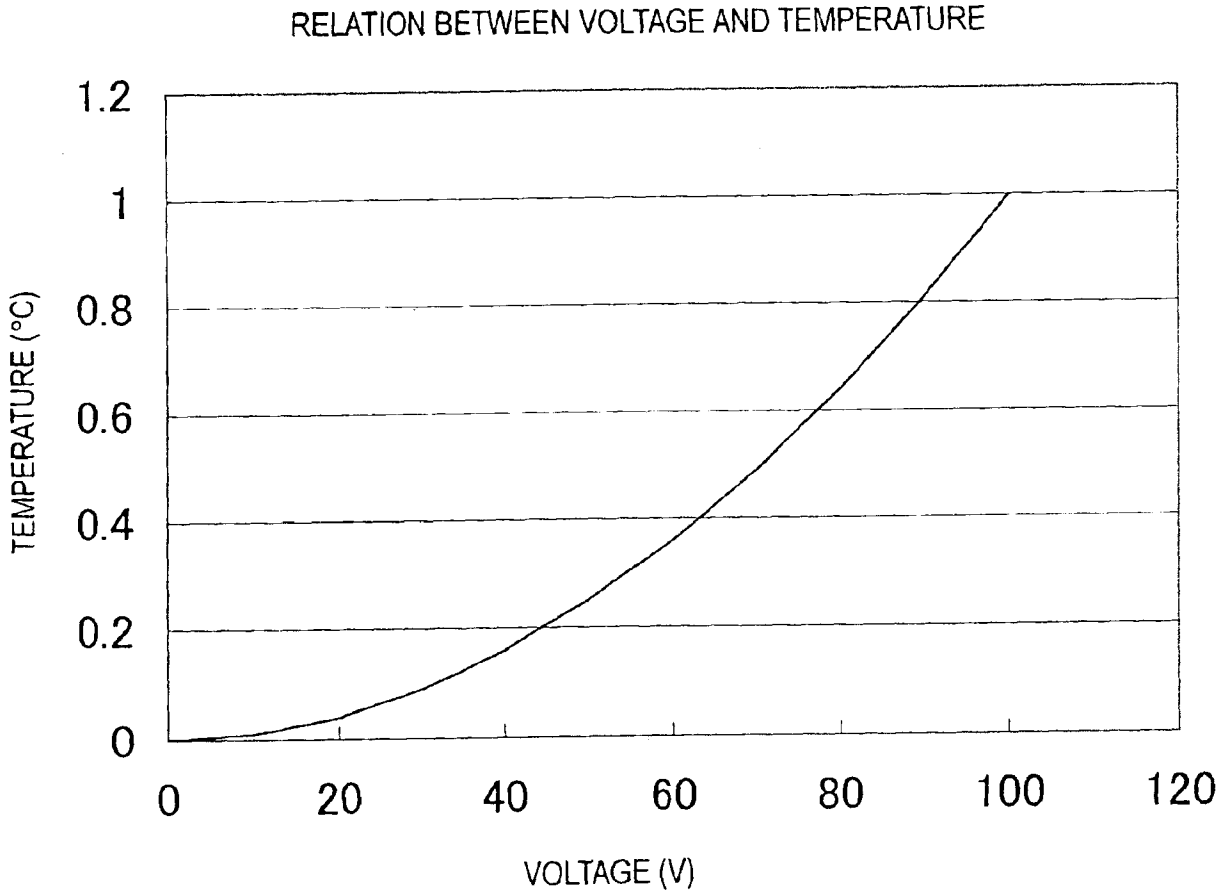
FIG. 4 is a graph showing a relation between a voltage and a temperature of the heater.

A relation between a voltage to be given to the heater 12 and a temperature to be obtained with respect to the voltage is shown in a graph of FIG. 4. This graph shows the voltage and the temperature measured with a duct diameter of 650×650 mm and a wind velocity of 2.5 m/s. Fifteen electric lamps of 85 W manufactured by Ushio Inc. are used as the electric lamps 20. In the graph of temperature and voltage shown in FIG. 4, the vertical axis indicates a temperature generated by the heater 12 and the horizontal axis indicates a voltage value given to the electric lamps 20. According to the graph, since the voltage applied to the electric lamps 20 and the temperature with respect to the voltage have one-to-one correspondence, it is seen that temperature control can be performed sufficiently by controlling the voltage applied to the electric lamps 20. With the heater 12 having such a structure, quick responsiveness to temperature control is improved by using radiant heat and transferred heat, which are generated by lighting the electric lamps 20, as heat sources for the heater 12.

Next, an air conditioner using the heater 12 will be described.

Figure 3:
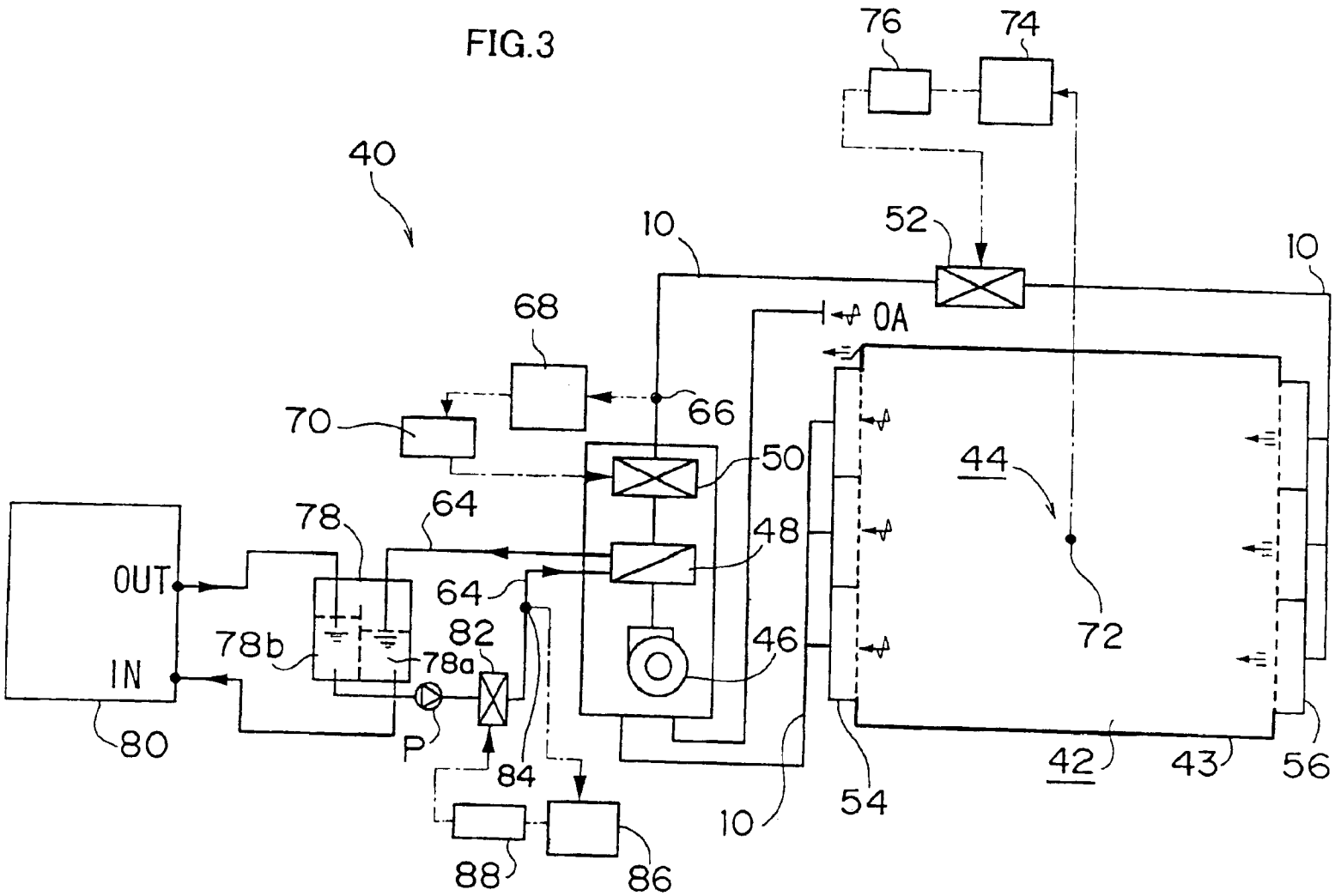
FIG. 3 is a diagram showing an air conditioner using the heater.

FIG. 3 is a diagram showing a structure of an air conditioner 40 in accordance with an embodiment of the present invention, which is applied in a precision environment chamber. A precision environment chamber 42 shown in the drawing is isolated from the outside by a partition wall 43. In the chamber, for example, a manufacturing line of precision instruments, an inspection apparatus, and the like are installed. In this precision environment chamber 42, temperature is required to be maintained constant within a tolerance in the order of ±1/1000° C. Although not illustrated in FIG. 3, the partition wall 43 is provided with an entrance having an opening/closing door for workers entering the chamber.

An air supply panel 56 is provided on a right wall surface on FIG. 3 of a wall surface of the partition wall 43, and an air suction panel 54 is provided on a left wall surface. As these panels 54 and 56, a porous panel such as punching metal, in which a large number of holes allowing air to pass and straightening the air flow are formed, is used.

The air duct 10 is connected to the air suction panel 54. A cooler 48 and heat source systems such as a first heater 50 and a second heater 52 including the duct unit 14 are provided in the air duct 10 in addition to a blower 46. This air duct 10 is connected to the air supply panel 56, whereby air in the precision environment chamber 42 can be circulated.

The blower 46 circulates the air in the precision environment chamber 42. When the blower 46 is actuated, the air in the precision environment chamber 42 is sucked from the air suction duct 54 into the air duct 10, and the air in the air duct 10 is delivered from the blower 46.

The cooler 48 cools the air delivered by the blower 46 to a predetermined temperature. A cooling coil (not shown) is provided inside this cooler 48, and the delivered air comes into contact with this cooling coil to be cooled. The cooler 48 will be described in detail later.

The first heater 50 includes the duct unit 14 provided with the electric lamps 20 in the inside thereof as described above (see FIG. 1). A first temperature sensor 66 is provided in the air duct 10 immediately behind the first heater 50 and measures temperature of a part immediately behind the first heater 50 in the air duct 10. The first temperature sensor 66 is connected to a digital controller 68 constituting a first control device. A thyristor 70 is controlled by the digital controller 68 according to temperature information of the first temperature sensor 66. Electricity is supplied from a power supply section (not shown) to the first heater 50 at a predetermined voltage value by the thyristor 70. A resolution in the digital controller 68 is ±1/100° C. The air cooled by the cooler 48 is heated to a temperature close to a required temperature by the first heater 50 with such a structure. For example, if the required temperature is set to 23.2° C., the air is subjected to heating control by the first heater 50 such that the temperature of the air rises to 22.9° C.

The second heater 52 also includes the duct unit 14 and is provided with the electric lamps 20 in the inside thereof. A second temperature sensor 72 is provided in the precision environment chamber 42 and measures temperature in the precision environment chamber 42. The second temperature sensor 72 is connected to a digital controller 74 constituting a second control device. A thyristor 76 is controlled by the digital controller 74 according to temperature information of the second temperature sensor 72. Electricity is supplied from a power supply section (not shown) to the second heater 52 by the thyristor 76 at a predetermined voltage. Here, the digital controller 74 has a resolution higher than that of the digital controller 68 and can control temperature in the precision environment chamber 42 in the order of ±1/1000° C. The air heated to the temperature close to the required temperature by the first heater 50 is heated again to a temperature required in the precision environment chamber 42 by the second heater 52 with such a structure. Consequently, in the second heater 52, since fluctuation of a controlled quantity of heat is less and control is easily performed, stabilization of air can be realized.

With the air conditioner 40 with such a structure, the air-conditioning air blown out from the air supply panel 56 is sucked from the air suction panel 54, thereby flowing as a side flow (horizontal laminar flow) in the precision environment chamber 42. Temperature is strictly controlled in the precision environment chamber 42, and the precision environment chamber 42 can be maintained at a temperature within a tolerance of 1/1000° C. at 23.2° C. In particular, with the side flow in the precision environment chamber 42, since holdup of air does not occur in the precision environment chamber 42, a temperature distribution in the precision environment chamber 42 tends to be uniform, and occurrence of a turbulent flow or the like can be prevented, temperature controllability is improved.

The first heater 50 and the second heater 52 are provided in the air duct 10 and the temperature sensor for controlling these heaters is attached to the air duct 10, whereby temperature control in two stages with different temperature resolutions is made possible, and the air conditioner 40 excellent in controllability can be provided. In particular, air is heated to a temperature close to a required temperature by the first heater and is maintained at a desired temperature by the second heater, fluctuation of a controlled quantity of heat of the heaters is reduced and control of room temperature of the precision environment chamber is easily performed, and stabilization of room temperature 42 can be realized.

Next, the cooler 48 and a chilled fluid temperature control device for controlling the cooler 48 will be described. A cooling coil (not shown) is provided in the inside of the cooler 48, and the air delivered as described above comes into contact with this cooling coil to be cooled. A chilled fluid pipe (fluid path) 64 is connected to the cooling coil. The chilled fluid pipe 64 is provided with a cushion tank 78, a chilled fluid producing apparatus 80, a heater 82, and the like, and chilled fluid in the chilled fluid pipe 64 can be circulated by a pump P.

The cushion tank 78 comprises sectioned two chilled fluid layers, and chilled fluid delivered from the cooler 48 is stored in one chilled fluid layer 78*a*. Chilled fluid produced in the chilled fluid producing apparatus 80 is stored in the other chilled fluid layer 78*b*.

The pump P circulates chilled fluid in the chilled fluid pipe 64. When the pump P is actuated, the pump P sucks the chilled fluid from the other chilled fluid layer of the cushion tank 78 and continuously conveys and supplies the chilled fluid in the chilled fluid pipe 64 to the heater 82.

As the heater 82, a heater provided with a heat transfer wire in a coil shape (or plate shape) is used. Heat is generated in the heat transfer wire by energizing the heat transfer wire from a power supply section (not shown), and chilled fluid conveyed by the pump P is heated to a desired temperature by bringing the chilled fluid into contact with the heat transfer wire. A temperature sensor 84 is provided immediately behind this heater 82 in the chilled fluid pipe 64 and measures temperature of a part immediately behind the heater 82 in the chilled fluid pipe 64. The temperature sensor 84 is connected to a digital controller 86 constituting a chilled fluid temperature control device. A temperature signal is outputted to a thyristor 88 from the digital controller 86 according to temperature information of the temperature sensor 84. A control signal according to feedback control is outputted by the thyristor 88. Electricity is supplied from a power supply section (not shown) to the heater 82 at a predetermined voltage value by the thyristor 88. With the cooler 48 having such a structure, chilled fluid can be cooled to a temperature within a tolerance at least in the order of 1/100 of that for a required temperature.

Chilled fluid, which is maintained at a predetermined temperature by the cooler 48 and the digital controller 86 with such structures, is continuously supplied to maintain air conveyed to the cooler 48 at a fixed temperature. In particular, compared with a conventional cooler which controls a flow rate of chilled fluid, quick responsiveness is high, highly accurate temperature control is possible, control of temperature in the precision environment chamber 42 is easily performed, and stabilization of room temperature can be realized.

Figure 5:
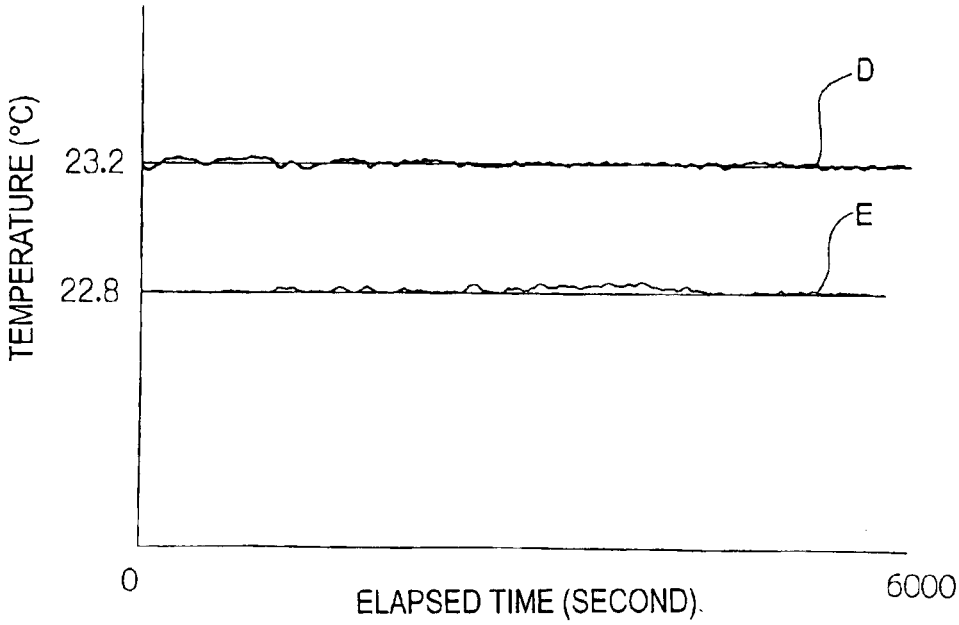
FIG. 5 is a graph showing temporal change in temperature of the air conditioner using the heater.
Figure 6:
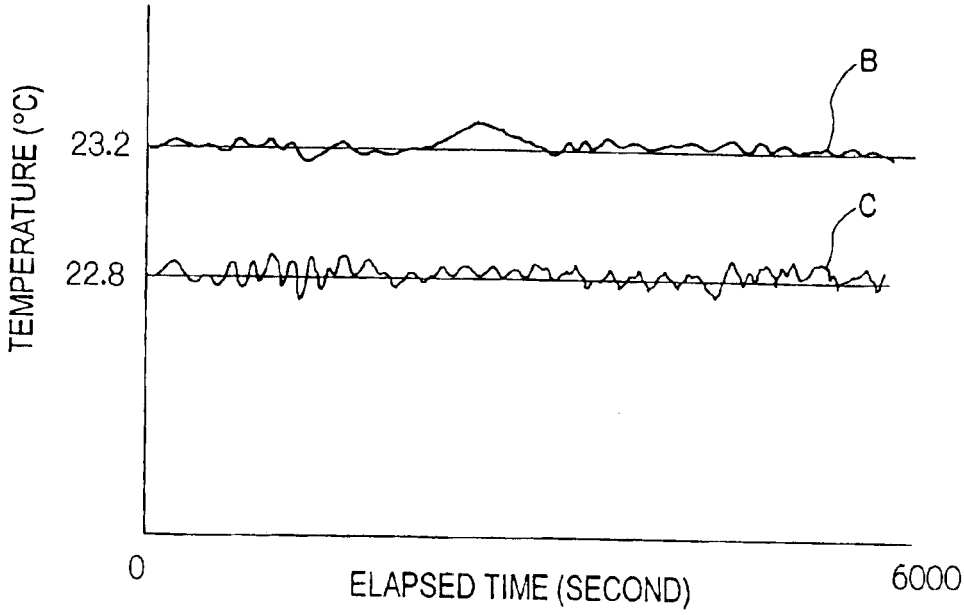
FIG.6 PRIOR ART
FIG. 6 is a graph showing temporal change in temperature of a conventional air conditioner.

Here, FIG. 5 shows a graph showing temporal change in temperature in the case where the heater in accordance with the present invention is applied to the air conditioner instead of a conventional heat transfer coil. FIG. 6 shows a graph showing temporal change in temperature in the case where a conventional heat transfer coil is applied to the air conditioner shown in FIG. 3. In these graphs showing temporal change in temperature, the vertical axis indicates a temperature and the horizontal axis indicates time, and solid lines B and D indicate temperatures measured in the second temperature sensor 72 in FIG. 3 and broken lines C and E indicate temperatures measured in the temperature sensor 66. In the graphs, a room temperature in the case where the conventional heat transfer coil is used (solid line B) and a room temperature in the case where the heater of the present invention is applied to the air conditioner (solid line D) are compared. Then, it is seen that, in the case where the heat transfer coil is used, a satisfactory result is not obtained even if control with high accuracy described in the above-described embodiment is applied, but a room temperature is stabilized remarkably and a satisfactory result is obtained by applying the heater of the present invention to the air conditioner.

The structures of the heater and the air conditioner indicated in the above-described embodiment are not limited to the embodiment. For example, in the case of extremely small variation in thermal load of the room and/or outside air, the conventional heat transfer wire wound in a coil shape may be used as the first heater, and the second heater on the downstream side may be constituted using electric lamps. The present invention may be applied to a room (clean room, etc.) which is not the precision environment chamber 42. In this case, the inside of the clean room can be maintained at a high degree of cleanliness if a dust removal apparatus, which can remove dust included in the air, is provided. The present invention can also be applied to an air duct of an air conditioner used in a general office building or the like.

Moreover, a shape of the ducts is not limited to rectangle but may be, for example, cylindrical. Although the blower 46 is set on the upstream side of the cooler 48 in the embodiment, it may be set on the downstream side of the first heater 50.

As described above, according to the heater in accordance with the present invention, since radiant heat and transferred heat generated by lighting electric lamps are used as heat sources for the heater, quick responsiveness to temperature control is improved.

According to the air conditioner using electric lamps in accordance with the present invention, the temperature sensors for controlling the first and second heaters are attached to the predetermined positions of the supply path and the air-conditioned room, respectively, whereby temperature control in two stages with different temperature resolutions is realized. Thus, an air conditioner which can control temperature of the air-conditioned room with high accuracy can be provided.

Moreover, according to the air conditioner in accordance with the present invention, since the heaters are provided in the duct unit, the duct unit only has to be removed from the supply path when the entire heaters are repaired or replaced. Thus, replacement work is facilitated. If the cover is opened to remove the heaters from the duct unit, maintenance of each member of the heaters can be performed.

Further, according to the air conditioner in accordance with the present invention, since a fixed amount of chilled fluid, which is subjected to temperature control, is continuously supplied to control temperature of the air rather than controlling a flow rate of the chilled fluid, highly accurate temperature control becomes possible. Since load of temperature control on the first heater is reduced by providing such a cooler on the upstream side of the first heater, highly accurate temperature control can also be realized in the first heater and temperature control by the second heater is improved accordingly. Thus, air of a fixed temperature subjected to temperature control in the order of 1/1000° C. for example, can be supplied to the air-conditioned room.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An air-conditioning control apparatus, comprising:

a heater which includes a heat source inside thereof and heats supplied air, wherein an electric lamp provided with a filament is used as the heat source, the filament is energized to light the electric lamp, heat generated by lighting the electric lamp is used as the heat source, and at least one said heater is arranged in a supply path for supplying air-conditioning air to an air-conditioned room; and an additional heater arranged in the supply path of air-conditioning air, wherein:

the heater is arranged in the supply path on a downstream side than the additional heater;

the additional heater arranged in the supply path on an upstream side is controlled by a first control device with a predetermined resolution according to temperature information from a first temperature sensor arranged on the supply path;

the heater arranged in the supply path on the downstream side is controlled by a second control device with a resolution higher than the first control device according to temperature information from a second temperature sensor arranged at a predetermined position in the air-conditioned room; and air-conditioning air subjected to temperature control with the higher resolution is supplied to the predetermined position.

2. An air-conditioning control apparatus, comprising:

a heater which includes a heat source inside thereof and heats supplied air, wherein an electric lamp provided with a filament is used as the heat source, the filament is energized to light the electric lamp, heat generated by lighting the electric lamp is used as the heat source, and at least one said heater is arranged in a supply path for supplying air-conditioning air to an air-conditioned room;

an additional heater arranged in the supply path of air-conditioning air, wherein:

the heater is arranged in the supply path on a downstream side than the additional heater;

the additional heater arranged in the supply path on an upstream side is controlled by a first control device with a predetermined resolution according to temperature information from a first temperature sensor arranged on the supply path;

the heater arranged in the supply path on the downstream side is controlled by a second control device with a resolution higher than the first control device according to temperature information from a second temperature sensor arranged at a predetermined position in the air-conditioned room;

air-conditioning air subjected to temperature control with the higher resolution is supplied to the predetermined position; and a cooler which cools air taken into the supply path to a predetermined temperature and is arranged in the supply path on an upstream side than the heater, the cooler comprising:

a pump which continuously supplies chilled fluid stored in a chilled fluid producing apparatus to the cooler via a fluid path;

a temperature sensor which measures temperature of the chilled fluid continuously supplied by the pump and is arranged on the fluid path; and a chilled fluid temperature control device which feedback controls temperature of the chilled fluid according to information from the temperature sensor and is arranged on the fluid path.

3. An air-conditioning control apparatus, comprising:

a heater which includes a heat source inside thereof and heats supplied air, wherein an electric lamp provided with a filament is used as the heat source, the filament is energized to light the electric lamp, heat generated by lighting the electric lamp is used as the heat source, and at least one said heater is arranged in a supply path for supplying air-conditioning air to an air-conditioned room;

an additional heater arranged in the supply path of air-conditioning air, wherein:

the heater is arranged in the supply path on a downstream side than the additional heater;

the additional heater arranged in the supply path on an upstream side is controlled by a first control device with a predetermined resolution according to temperature information from a first temperature sensor arranged on the supply path;

the heater arranged in the supply path on the downstream side is controlled by a second control device with a resolution higher than the first control device according to temperature information from a second temperature sensor arranged at a predetermined position in the air-conditioned room;

air-conditioning air subjected to temperature control with the higher resolution is supplied to the predetermined position;

the heater is arranged in a duct unit detachably attached to the supply path; and an opening for removing the heater from the duct unit is formed in the duct unit, and a cover for opening and closing the opening is attached to the opening.

4. An air-conditioning control apparatus, comprising:

a heater which includes a heat source inside thereof and heats supplied air, wherein an electric lamp provided with a filament is used as the heat source, the filament is energized to light the electric lamp, heat generated by lighting the electric lamp is used as the heat source, and at least one said heater is arranged in a supply path for supplying air-conditioning air to an air-conditioned room;

an additional heater arranged in the supply path of air-conditioning air, wherein:

the heater is arranged in the supply path on a downstream side than the additional heater;

the additional heater arranged in the supply path on an upstream side is controlled by a first control device with a predetermined resolution according to temperature information from a first temperature sensor arranged on the supply path;

the heater arranged in the supply path on the downstream side is controlled by a second control device with a resolution higher than the first control device according to temperature information from a second temperature sensor arranged at a predetermined position in the air-conditioned room;

air-conditioning air subjected to temperature control with the higher resolution is supplied to the predetermined position;

the heater is arranged in a duct unit detachably attached to the supply path;

an opening for removing the heater from the duct unit is formed in the duct unit, and a cover for opening and closing the opening is attached to the opening; and a cooler which cools air taken into the supply path to a predetermined temperature and is arranged in the supply path on an upstream side than the heater, the cooler comprising:

a pump which continuously supplies chilled fluid stored in a chilled fluid producing apparatus to the cooler via a fluid path;

a temperature sensor which measures temperature of the chilled fluid continuously supplied by the pump and is arranged on the fluid path; and a chilled fluid temperature control device which feedback controls temperature of the chilled fluid according to information from the temperature sensor and is arranged on the fluid path.

* * * * *